United States Patent [19]

Kinkaid et al.

[11] 4,021,095

[45] May 3, 1977

[54] STACKED CARRIER STRIP ASSEMBLY

[75] Inventors: Robert John Kinkaid, New Cumberland; John Carl Asick, Harrisburg, both of Pa.

[73] Assignee: AMP Incorporated, Harrisburg, Pa.

[22] Filed: Feb. 21, 1974

[21] Appl. No.: 444,621

[52] U.S. Cl. ..... 339/276 SF; 206/330

[51] Int. Cl.[2] ..... H01R 11/08

[58] Field of Search ..... 339/276 SF; 29/193.5; 206/330

[56] References Cited

UNITED STATES PATENTS

| | | | |
|---|---|---|---|
| 3,550,856 | 12/1970 | Wise et al. | 339/276 SF |
| 3,650,706 | 3/1972 | Parsons | 206/330 |

*Primary Examiner*—Joseph H. McGlynn
*Attorney, Agent, or Firm*—Gerald K. Kita

[57] ABSTRACT

A carrier strip having a plurality of electrical terminals thereon is stamped and formed with alternating tab and recess portions. The carrier strip is adapted to be conveyed through an insertion machine which severs the terminals from the strip and inserts the terminals into a workpiece. To achieve closer spacing of the terminals and consequent increase in speed of terminal insertion within a workpiece, the carrier strip is adapted for stacking upon itself to provide multiple layers of carrier strips which are conveyed simultaneously to the insertion machine. For effective registration and interlocking of the stacked layers the carrier strip is purposely provided with a stamped and formed interlocking geometry. Multiple lengths of carrier strips according to the present invention may be conveyed simultaneously to an insertion machine where stacked registration is accomplished immediately prior to the insertion station of the machine.

6 Claims, 7 Drawing Figures

Fig 1
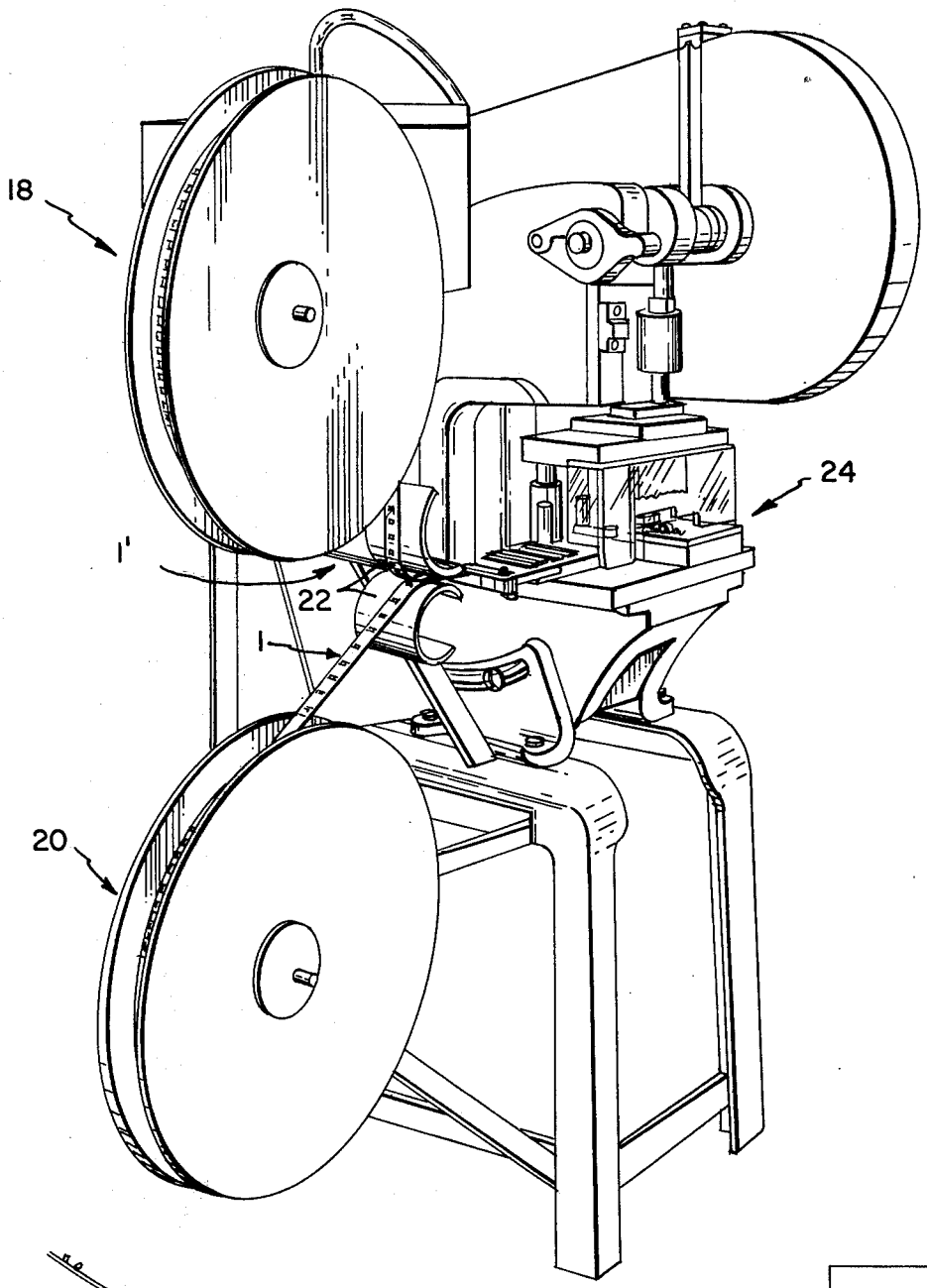
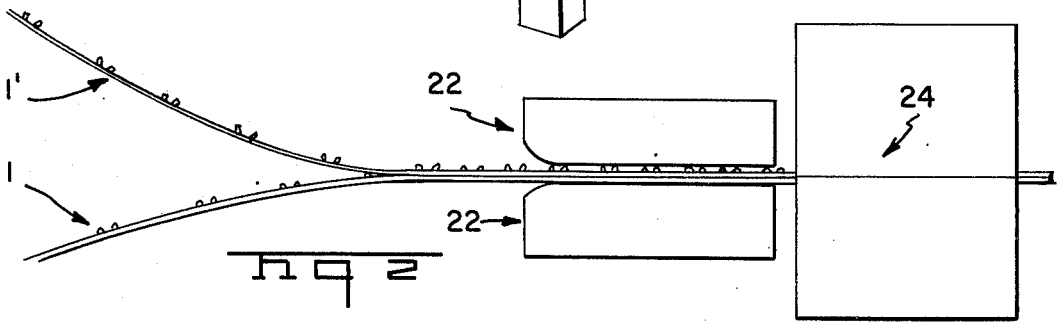
Fig 2

Fig. 4
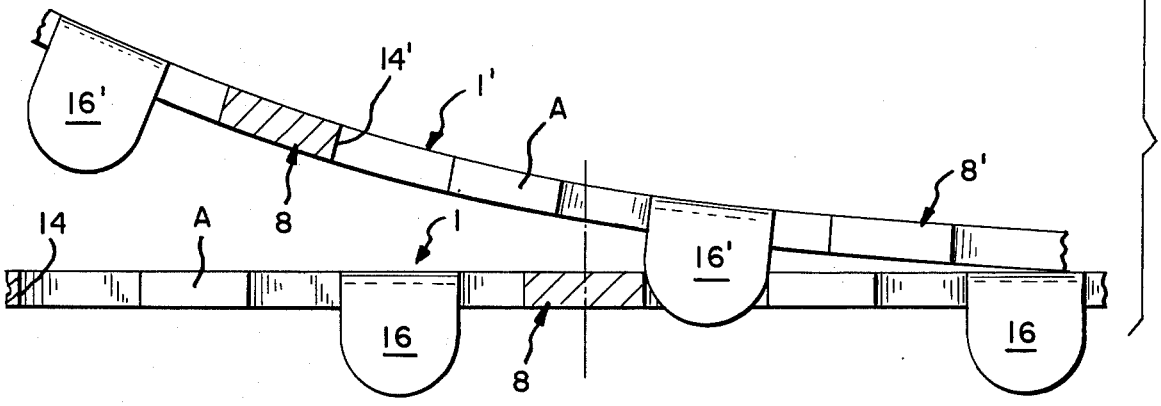
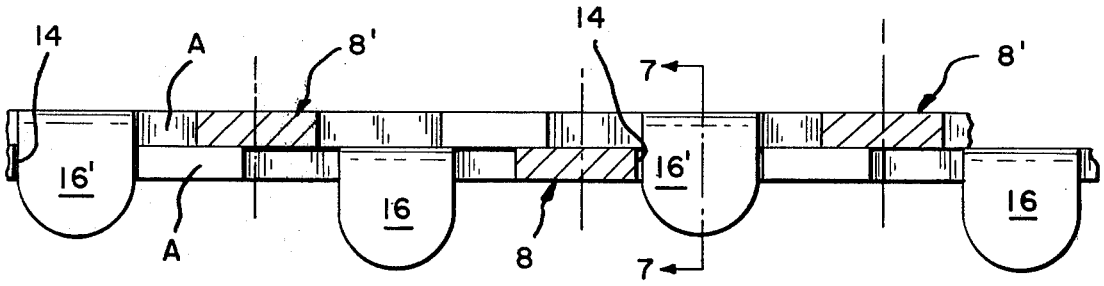
Fig. 5
Fig. 6
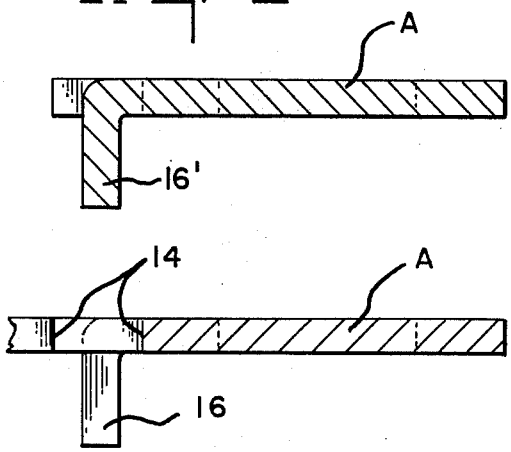
Fig. 7
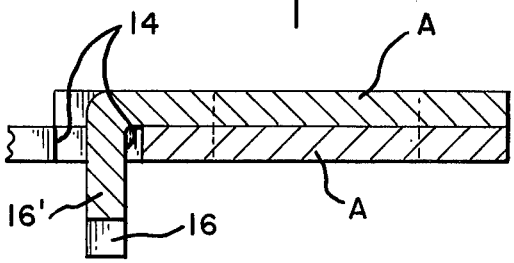

STACKED CARRIER STRIP ASSEMBLY

BACKGROUNDOF THE PRIOR ART

It is well-known in the prior art to provide a plurality of electrical terminals which are stamped and formed in a stamping press from a continuous strip of metal, with a portion of the metal strip remaining integral with each of the terminals to provide a carrier strip along which the terminals are serially spaced. The integral carrier strip allows for conveyance of the terminals in serial relationship through an insertion machine, typically having a severing station where terminals are removed from the strip, and an insertion station where the removed terminals are individually inserted within a workpiece, such as a printed circuit board, a connector housing, or other workpiece to which the terminals are either mounted or contained. In practice the terminals are inserted one at a time by the insertion machine, necessitating indexing of the carrier strip repeatedly to position each terminal in succession at the severing and insertion stations. The speed of the required indexing and consequently the speed of the insertion machine operation depends on the amount of spacing between adjacent terminals along the integral carrier strip. In turn, spacing of the terminals depends upon the size and the complexity of the terminals stamped and formed from the continual strip of metal. More particularly, the larger or more complex the three dimensional bodies of the terminals, the greater the amount of metal must be consumed from the metal strip to form the terminals. The greater the amount of metal consumed, the further apart the terminals are required to be spaced along the integral carrier strip. Often such spacing becomes excessive since substantial lost motion and assembly time results when the terminals must be individually indexed by advancing repeatedly the carrier strip to the severing and insertion stations of the machine.

It is desirable to reduce to time lost in individually indexing the terminals by severing and inserting a plurality of terminals simultaneously. However, the spacing of a plurality of terminals along the carrier strip does not often coincide with the required spacing of the terminals when mounted or contained within a workpiece. Thus it has been heretofore difficult to transfer a plurality of terminals simultaneously from a carrier strip to a workpiece without eliminating the need for indexing the terminals or the workpiece to achieve the required spacing of the terminals on the workpiece.

According to the present invention, a plurality of carrier strips are adapted to be stacked together immediately prior to being simultaneously conveyed to an insertion machine. The stacked carrier strips are mutually offset such that the terminals thereof are serially arranged on closer spacing than are the terminals along any one of the stacked carrier strips. Whereas closely spacing the terminals for simultaneous insertion into a workpiece is achieved, maintaining the carrier strips in stacked registration is difficult. It was first believed that the carrier strips should be assembled in stacked relationship and than fastened together to make a single composite carrier strip which could be reeled up on a spool for storage and subsequently supplied to the insertion machine when needed. Such a procedure has a disadvantage in that the composite strip has to be fabricated as a subassembly from individual carrier strips which were themselves already reeled up and stored on spools as the carrier strips emerged from stamping and forming presses. More particularly individual carrier strips are required to be unreeled, registered in stacked relationship, fastened together to make a composite strip and then the composite strip reeled up on a separate spool. The present invention advantageously eliminates fabrication of the subassembly. The present invention eliminates the need for individual carrier strips to be unreeled from their original storage spools until finally utilized in an insertion machine. Desired registration of the individual strips in stacked relationship is attained without further processing or modification of the individual carrier strips. Since the individual carrier strips are undisturbed from their original storage spools, the carrier strips can be used either individually or in stacked relationship as desired without a need for modifying the carrier strip or terminals and without a need for fabricating a subassembly. As a further advantage each individual carrier strip is designed such that any selected length or part of the individual carrier strip is stackable upon itself or upon another additional part of the same carrier strip. This is accomplished by stamping and forming an interlocking geometry of the carrier strip during the same stamping and forming operation utilized to form the carrier strip and the integral terminals thereof.

Each of the stacked carrier strips is stamped and formed with an interlocking geometry which interlocks the carrier strips together. The interlocking geometry thus assures proper registration between stacked layers of strips and thereby precisely locates the terminals of the stacked carrier strips serially in compact spacing. This permits a properly designed insertion machine to simultaneously insert a plurality of terminals within equally precisely arranged locations in a workpiece. The interlocking geometry is purposely selected to permit an individual carrier strip to be stacked upon itself thereby advantageously eliminating the need for matching varied geometries of carrier strips required for interlocking. Advantageously only a single geometry of carrier strip is required to interlock a plurality of carrier strips in stacked configurations.

OBJECTS OF THE PRESENT INVENTION

It is therefore an object of the present invention to provide a technique for compact serial spacing of electrical terminals by interlocking multiple layers of carrier strips in precise stacked registration whereby the electrical terminals on the stacked carrier strips are serially arranged.

Another object of the present invention is to provide a carrier strip with a configuration or geometry allowing interlocking between multiple lengths of the carrier strip placed in stacked relationship whereby electrical terminals serially arranged on the stacked lengths of carrier strips are arranged in compact serial spacing and whereby stacking of the lengths of carrier strips is accomplished by continuously conveying the lengths of carrier strips into mutual engagement immediately adjacent to an insertion machine.

Another object of the present invention is to provide a repeating tab and recess configuration on a continuous carrier strip to allow stacking of multiple lengths of the carrier strip with the tab and recess configurations interlocking to maintain the lengths of carrier strips in precise stacked registration.

Another object of the present invention is to provide a plurality of electrical terminals, which are initially distributed along a carrier strip, in relatively compact serial spacing by stacking and interlocking a plurality of carrier strip lengths together to form a single composite carrier strip with all the terminals of the carrier strips serially arranged along the composite carrier strip.

Other objects and many attendant advantages of the present invention will become apparent upon perusal of the following detailed description taken in conjunction with the drawings.

DESCRIPTION OF THE DRAWINGS

FIG. 2 is a schematic representation of the machine illustrated in FIG. 1;

FIG. 3 is a fragmentary enlarged perspective of a length of carrier strip according to the present invention together with terminals integral with the carrier strip and serially spaced therealong;

FIG. 4 is a fragmentary enlarged elevation of two lengths of carrier strip according to the present invention illustrated in exploded configuration;

FIG. 5 is a fragmentary enlarged elevation in section illustrating the carrier strips of FIG. 4 in stacked configuration;

FIG. 6 is a section taken along the line 6—6 of the FIG. 4; and FIG. 7 is a section taken along the line 7—7 of FIG. 5.

DESCRIPTION OF THE PREFERRED EMBODIMENTS

Figure 1:
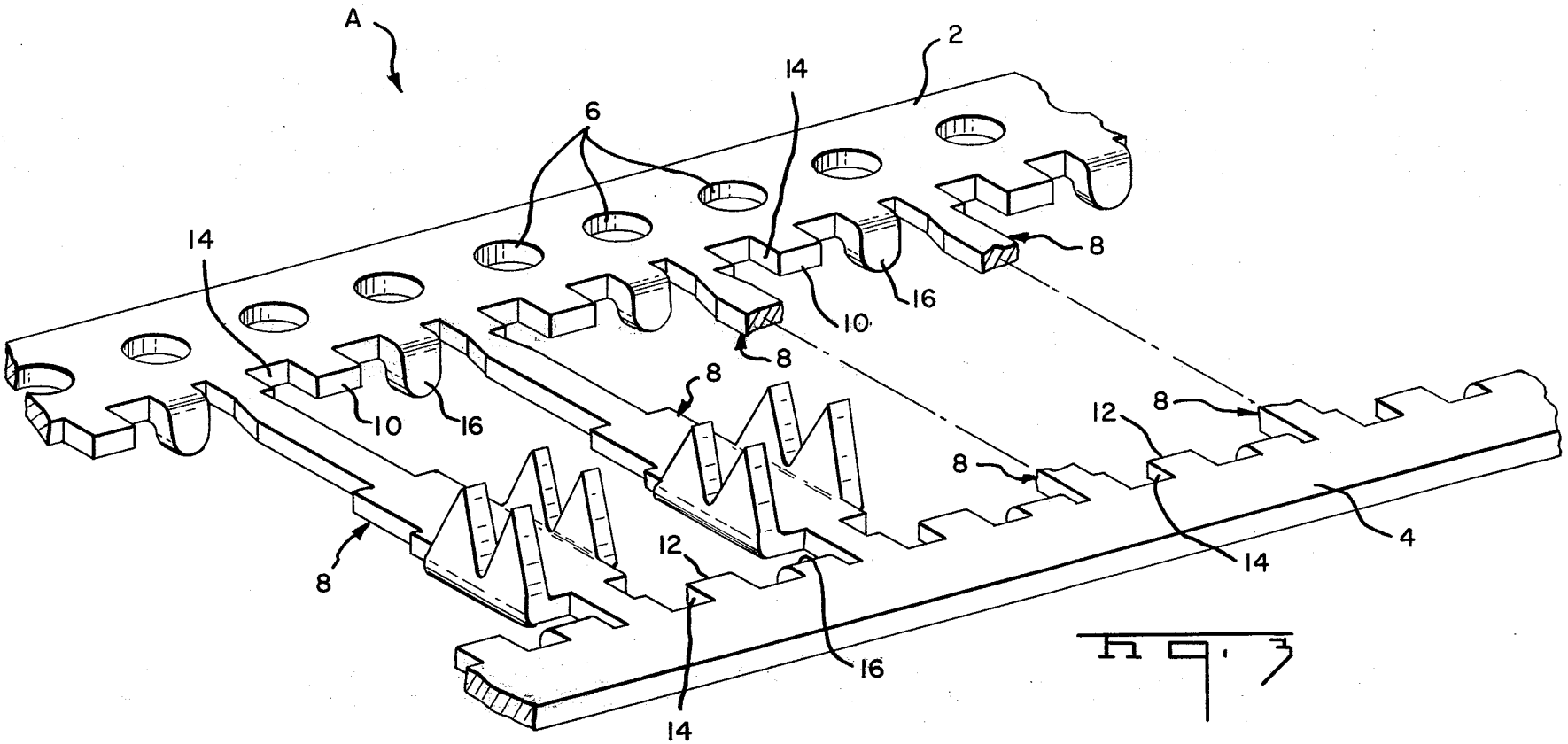
FIG. 1 is a perspective of a typical insertion machine which advantageously stacks lengths of carrier strips according to the present invention immediately prior to inserting the terminals on the stacked carrier strips within a workpiece.

With more particular reference to FIG. 3, there is illustrated generally at A a carrier strip having which is stamped and formed in a stamping press from a continuous strip of metal. The carrier strip is formed with a configuration having two parallel spaced metal margins 2 and 4 advantageously formed from the elongated side margins of a continuous metal strip. The metal margin 2 includes a plurality of serially spaced pilot holes 6 which are stamped into the margin 2 during the stamping and forming operation, and which are utilized to convey the carrier strip A through an insertion machine in the well-known manner. The pair of margins or strips 2 and 4 are integral with a plurality of electrical terminals which are also stamped from the continuous strip of metal together with the metal strips 2 and 4. The terminals, exemplary ones of which are illustrated at 8 are integral with the metal strips 2 and 4 and are serially spaced therealong.

In accordance with the objects of the present invention, the individual carrier strip A is designed so that any selected length or part of the carrier strip is stackable upon itself or upon another additional part or length of the same carrier strip. This is accomplished by stamping and forming an interlocking geometry on the carrier strip margins 2 and 4 during the same stamping and forming operation utilized to form the carrier strip and the integral terminals 8. More particularly, the inwardly directed side margin 10 and 12 of the strips 2 and 4, respectively, oppose each other as shown in FIG. 3. Between adjacent terminals 8, each side margin is provided with a generally rectangular recessed portion 14 and a projecting tab portion 16. Since the adjacent terminals 8 are spaced serially along the carrier strip, sufficient room is provided for at least one recessed portion 14 and one tab portion 16 between adjacent terminals. As shown, each of the tab portions 16 is bent out of the plane of the metal strips 2 and 4. Such ending or forming is accomplished in the stamping operation utilized to stamp and form the carrier strip A and the terminals 8. As heretofore explained, the spacing between adjacent terminals 8 on the carrier strip depends upon the amount of metal necessarily consumed in forming the three-dimensional configurations of the terminals. Thus the more complex or the larger the body portions of the terminals the further apart the terminals must be spaced along the carrier strip 1.

As shown in FIG. 4, a length 1 of the carrier strip A is illustrated in stacked relationship with a second portion or length of the carrier strip A, with the second length of the carrier strip being designated by 1′. When placed in stacked relationship the two lengths of carrier strip may be brought into stacked registration as shown in FIG. 5. More particularly, the depending tab portions 16′ of the second length 1′ of carrier strip may be brought into registration within the corresponding recessed portions 14 of the first length 1 of the carrier strip. For example, the tab portions 16′ may be provided with an interference fit within the recessed portions 14 to interlock the carrier strip lengths 1 and 1′ in stacked registration to provide a composite carrier strip of stacked individual lengths. The terminals 8 and 8′ of the individual carrier strip lengths 1 and 1′ are therefore serially arranged in relatively dense spacing on the composite carrier strip. Accordingly by stacking individual lengths of carrier strip as shown the terminals 8 and 8′ of the stacked carrier strip lengths may be located on relatively dense spacing.

As shown in FIGS. 3 and 5, since the opposed inner side margins of the individual strip portions 2 and 4 are provided with the interlocking geometry as described, the depending tab portions will become interposed between the margins 2 and 4 as well as becoming interlocked within corresponding recessed portions 14 of the individual strips 2 and 4. Such interlocking prevents shifting of the stacked carrier strip lengths either longitudinally or laterally, whereby the serially arranged terminals 8 and 8′ are maintained precisely in serially arranged locations without a need for positively fastening the stacked carrier strip lengths together. In addition, the tab portions 16′ having an interference fit within the recessed portions 14 also eliminate the need for positively securing the stacked lengths of carrier strips together. In addition the free ends of the tab portions 16′ and 16 are provided with arcuately tapered configurations to assist in alignment and insertion of the tab portions within corresponding recessed portions 14.

The individual length of carrier strip A, when manufactured with such an interlocking geometry as described, may be reeled up on separate storage reels. This is shown in FIG. 3 wherein a pair of storage spools 18 and 20 each is provided with a substantially long continuous length of carrier strip A having a configuration as shown in FIG. 3. Each length of carrier strip A is inherently flexible to allow for reeling up on a storage spool. To place the carrier strips in stacked relationship, it is not necessary to unreel substantial lengths of the carrier strip in order to obtain interlocking of the carrier strip lengths together in stacked relationship. Instead, as shown in FIG. 4 it is only necessary that a single tab portion 16′ be received within a corresponding recess portion 14 to assure proper alignment of the carrier strip lengths for stacking. Once such an interlocking relationship is established, the carrier strip lengths are then properly oriented such that continued unreeling of the lengths of carrier strip from the spools 18 and 20 will cause additional portions of the carrier strip lengths to merge into proper orientation for stacked registration. Thus as shown in FIG. 1, and as also shown schematically in FIG. 2 a pair of arcuate deflecting diverters 22 are mounted immediately prior to or in front of an insertion station 24 of a terminal insertion machine. The insertion machine may be of any type well-known in the prior art and may be of the type which continuously advances the lengths 1 and 1' of the carrier strip A. Once any portion of the corresponding lengths 1 and 1' of the carrier strip are interlocked, continued unreeling and advancing or conveying of the carrier strip lengths between the diverters 22 will continuously bring additional unreeled portions of the carrier strip lengths into stacked registration to form a composite carrier strip, with the terminals of the carrier strip lengths being continuously advanced to serial alignment in relatively dense spacing. In a typical stamping machine as illustrated in FIG. 1, provision is made to continuously advance the composite carrier strip, for example by a well-known driving mechanism which engages the pilot holes 6 of the individual carrier strip A to serially advance the composite strip into the insertion station 24 of the machine. The lengths 1 and 1' of the carrier strip A need not be preassembled in stacked relationship but may be merely conveyed toward the insertion station 24 of the machine. This has the advantage that either one or a plurality of lengths of carrier strip A may be utilized in the same machine as desired merely by selecting one or any number of carrier strip lengths to be conveyed simultaneously toward the machine. Thus when the machine is required to insert a plurality of terminals in relatively dense spacing, a plurality of carrier strip lengths may be simultaneously conveyed through the machine to locate a plurality of terminals at the machine insertion station for insertion into a workpiece on relatively dense spacing. When the machine is utilized to insert terminals into a workpiece in relatively wide apart spacings, only a single length of carrier A is required to be conveyed in the machine to the work station 24. Thus the carrier strip configuration according to the present invention has the advantage that individual lengths of carrier strip may be interlocked in stacked registration merely by continuously conveying a plurality of lengths of carrier strip into mutual engagement.

Although a preferred embodiment of the present invention is illustrated and described in detail, other modifications and embodiments of the present invention will become apparent to one having ordinary skill in the art from the spirit and scope of the appended claims.

We claim:

1. a carrier strip fed electrical terminal assembly comprising:

a plurality of stamped and formed electrical terminals spaced serially along an integral carrier strip, said carrier strip comprising a pair of spaced metal strips with said terminals bridging between the metal strips, the opposed inner side margins of said metal strips being provided with alternating tab portions and recess portions, said tab portions being bent out of the plane of said metal strips in depending relationship therefrom, and said tab portions of one length of said carrier strip being adapted for registration within the recess portions of another length of said carrier strip when said lengths of said carrier strip are in stacked relationship with the terminals of said one length of carrier strip alternating with the terminals of said another length of carrier strip.

2. The structure as recited in claim 1, wherein, said tab portions have widths slightly larger than the widths of said recess portions, such that the tab portions of said one length of carrier strip are force-fit in the recess portions of said another length of carrier strip to interlock said lengths

3. An assembly of carrier strips for locating electrical terminals in desired compact serial relationship, comprising:

a first length of carrier strip having a plurality of outwardly projecting and serially spaced electrical terminals, a second length of carrier strip having a second plurality of outwardly projecting and serially spaced electrical terminals, said first length of carrier strip having projecting portions for registration with said second length of carrier strip end for interlocking said first and second lengths of carrier strips in stacked relationship, said terminals of said first length of carrier strip alternating with said terminals of said second length of carrier strip.

4. The structure as recited in claim 3, wherein, said second length of carrier strip has recess portions receiving said projecting portions of said first length of carrier strip.

5. The structure as recited in claim 4, wherein, said projecting portions are bent out of the plane of said first length of carrier strip, and said projecting portions have tapered edges facilitating both registration and entry of said projecting portions into said recess portions whereby said lengths of carrier strip are interlocked in stacked registration.

6. A method of locating a plurality of electrical terminals along a carrier strip in compact serial spacing, comprising the steps of:

stamping and forming a plurality of electrical terminals along an integral carrier strip and providing a selected interlocking geometry on said carrier strip, storing at least two separate lengths of said carrier strip in reeled relationship upon separate storage spools, continuously unreeling said separate lengths of carrier strip simultaneously from said storage spools, continuously conveying said lengths of carrier strip into mutual engagement, with each of the terminals of one of the lengths of carrier strip being placed in compact serial relationship. With alternating ones of the terminals of the other length of carrier strip, and interlocking said lengths of carrier strip together by interlocking said locking geometry thereof and forming a composite carrier strip assembly.

* * * * *

UNITED STATES PATENT OFFICE
CERTIFICATE OF CORRECTION

PATENT NO. : 4,021,095
DATED : May 3, 1977
INVENTOR(S) : ROBERT JOHN KINKAID & JOHN CARL ASICK

It is certified that error appears in the above-identified patent and that said Letters Patent are hereby corrected as shown below:

Column 6, Claim 2, line 19, after "lengths" the words ---of carrier strip together--- should be inserted.

Column 6, Claim 6, line 65, "locking" should be ---interlocking---.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*